United States Patent [19]

Beckman et al.

[11] 4,174,036

[45] Nov. 13, 1979

[54] REPLACEMENT MOTOR KIT AND PARTS THEREOF

[75] Inventors: Daniel L. Beckman; Earl D. Stauffer, both of Fort Wayne, Ind.

[73] Assignee: General Electric Company, Fort Wayne, Ind.

[21] Appl. No.: 884,907

[22] Filed: Mar. 9, 1978

Related U.S. Application Data

[62] Division of Ser. No. 560,729, Mar. 21, 1975, which is a division of Ser. No. 307,965, Nov. 20, 1972, abandoned.

[51] Int. Cl.[2] ..... B65D 85/68

[52] U.S. Cl. ..... 206/223; 206/319; 206/591

[58] Field of Search ..... 206/223, 319, 523, 577, 206/588, 589, 590, 591, 592, 820

[56] References Cited

U.S. PATENT DOCUMENTS

| | | | |
|---|---|---|---|
| 2,477,512 | 7/1949 | Dunneback | 206/591 |
| 2,546,921 | 3/1951 | Dunneback | 206/591 |
| 2,733,851 | 2/1956 | Van Ness | 206/319 |
| 3,232,420 | 2/1966 | Haenle, Jr. | 206/577 |
| 3,414,121 | 12/1968 | Suzuki | 206/523 |
| 3,955,704 | 5/1976 | Smith et al. | 206/523 |

*Primary Examiner*—William T. Dixson, Jr.
*Attorney, Agent, or Firm*—Ralph E. Krisher

[57] ABSTRACT

Replacement motor kit includes compartmentalized container having at least a motor stator (or, preferably, an assembled stator and rotor) arranged in one compartment thereof; and preselected components arranged in at least one other compartment. Motor shafts have weakened external sections, such as grooves or notches. Such sections are proportioned to permit breaking of shaft by gripping it on both sides of a notch or groove with pliers, and then stressing and breaking the shaft at the notch or groove. Plural grooves or notches may be provided.

8 Claims, 11 Drawing Figures

REPLACEMENT MOTOR KIT AND PARTS THEREOF

CROSS REFERENCE TO RELATED APPLICATION

This application is a division of our co-pending application Ser. No. 560,729, filed Mar. 21, 1975, which in turn was a division of our then co-pending application Ser. No. 307,965 which was filed on Nov. 20, 1972 now abandoned. The entire disclosures of both of these applications are incorporated herein by reference.

BACKGROUND OF THE INVENTION

The present invention relates to dynamoelectric machines and, more particularly, to replacement motor kits and parts thereof; such motors being marketable to provide replacement motors interchangeable with motors that have failed in the field.

Different types of equipment used in homes or elsewhere are equipped with electric motors. Malfunctions or failure of the motor in such equipment may impair or stop the use of the equipment until the malfunctioning motor is repaired or replaced. When motor malfunction or failure occurs, the owner or operator of the equipment is at least inconvenienced and, to an ever increasing extent, the cost of repairing or replacing a motor within such equipment may be disproportionate as compared to the original manufacturing cost of the motor.

For example, in the case of domestic household refrigerators which are provided with evaporator fans, the fan motors that are used to circulate air across the evaporator coils typically represent a very small fraction of the total cost of manufacturing the refrigerator. This is particularly the case when such motors have been manufactured on a large volume production basis. Motors of this type may be as described in Rutledge et al U.S. Pat. No. 3,359,628.

Motors constructed using this approach generally are not repairable if bearing failure occurs, and the entire motor must be replaced if bearing failure occurs in the field. In addition, even if "repairable" motors were used for these types of applications, it would be the generally more economical practice to replace rather than attempt to repair them in the field.

Even though extensive efforts are made to provide motors having a more than sufficient expected service life, inadvertent failures or malfunctions of small fan motors nonetheless occur. Because of this, it has become a general practice in the industry for service shops to carry an inventory of motors that are then used to replace motors in the field. However, due to an increasing number of manufacturing sources of appliances and motors, it is necessary for service shops to carry an ever increasing inventory of different motors. Most of these motors are not interchangeable, one with another, because of (among other things) differences in shaft length, differences in shaft diameter, and different mounting features or mounting adapters.

The net effect of this situation upon the ultimate equipment or appliance user is that the cost of replacing a relatively small component in a given apparatus has continued to become increasingly great. While the reasons for such increased expense are explainable, such explanations provide little solace to the user. Different approaches have been considered and attempted to at least partly remedy the problems just discussed, but such approaches have not been completely satisfactory.

For example, replacement motors with extra long shafts have been modified by sawing off part of the shaft. This however, can result in bending the shaft-particularly in the case of small motors having small shaft diameters. A bent shaft of course may cause vibration and noise during operation and also may contribute to premature failure of the bearings in the replacement motor.

We have concluded that it would be desirable to provide a motor arrangement whereby a motor manufacturer can provide a single unit or package to wholesalers or service repair stations which can be used to replace numerous different motors in the field that are not directly interchangeable one with another. By doing this, we believe that further savings can be realized since it would become feasible to manufacture replacement motor arrangements on a continuing production basis.

SUMMARY OF THE INVENTION

It is therefore an object of the present invention to provide a replacement motor kit arrangement that may be used to provide a direct replacement for two or more previously manufactured motors that are not interchangeable one with another.

A more specific object of the present invention is to provide a replacement motor kit that includes selected motor and other parts that may be used to replace a plurality of different motors which are not interchangeable one with another.

It is a more specific object of the invention to provide a motor for a kit and constructed so that the shaft may be quickly shortened, when practicing our invention.

In carrying out the objects of the invention in one form, we provide a replacement motor kit that includes a compartmentalized container having at least a motor stator (or, preferably, an assembled stator and rotor) arranged in one compartment thereof; and preselected components arranged in at least one other compartment. The motor shafts have weakened external sections, such as grooves or notches. These sections are proportioned so that a person may break the shaft by gripping it on both sides of a notch with pliers, and then stressing and breaking the shaft at the notch (or groove).

The subject matter which we regard as our invention is set forth in the claims appended to and forming a part of this specification. The invention itself, however, together with further objects and advantages thereof may be better understood by referring to the following more detailed description taken in conjunction with the accompanying drawings.

DESCRIPTION OF THE PREFERRED EMBODIMENTS

Figure 1:
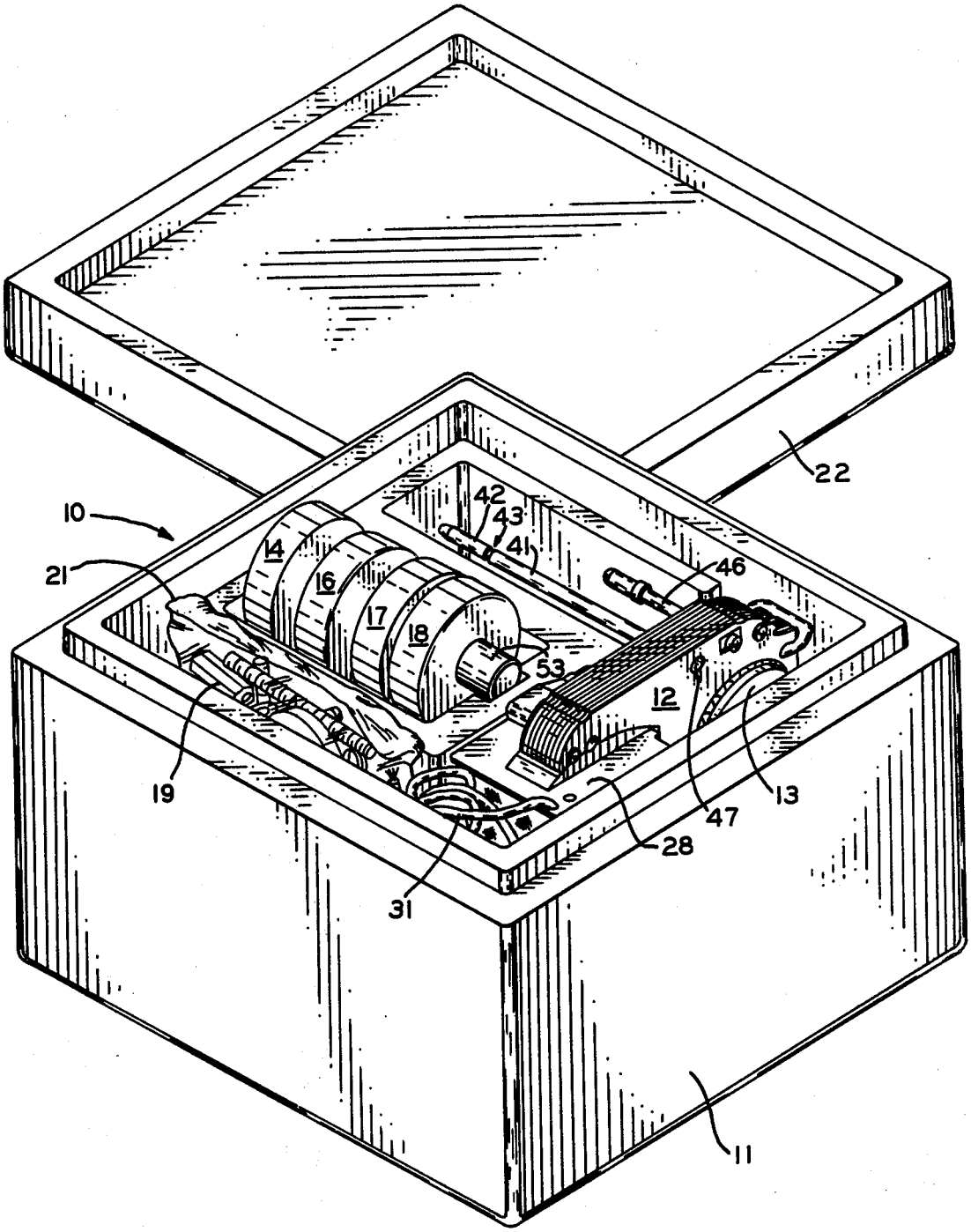
FIG. 1 is a view in perspective of a kit embodying our invention in one form thereof.

With particular reference now to FIG. 1, the motor kit 10 includes a compartmentalized package 11, motor stator assembly 12, rotor assembly 13, lubricant reservoirs 14, 16, 17, 18, and mounting means generally denoted by the reference numeral 19.

All of the above enumerated parts of the kit are disposed in an associated compartment of the container 11. For convenience, mounting means 19 (which may include, e.g., threaded studs, internally threaded bushings, non-threaded bushings, screws, and resilient members) may conveniently be segregated from the other contents of the container 11 by packaging such means separately, e.g., in a plastic envelope or bag 21.

Figure 3:
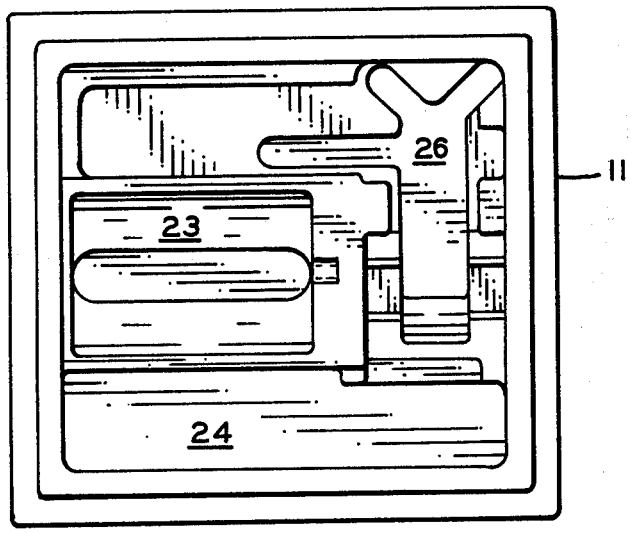
FIG. 3 is a plan view of the container portion of the kit shown in FIG. 1.

The container 11 includes a cover 22 and may be made from any suitable material as will be understood. For maximum protection of the packaged motor parts during handling and shipping, a cellular material preferably is used. For example, expanded or cellular plastic materials may be used. The container 11 and cover 22 thus may be made of expanded synthetic resinous material, such as polystyrene plastic; a commercially known type of which is marketed under the name "Styrofoam". Preferably, the container is compartmentalized. FIG. 3 clearly reveals separate compartments 23, 24, and 26, all contoured to accommodate the parts shown in FIG. 1.

Figure 2:
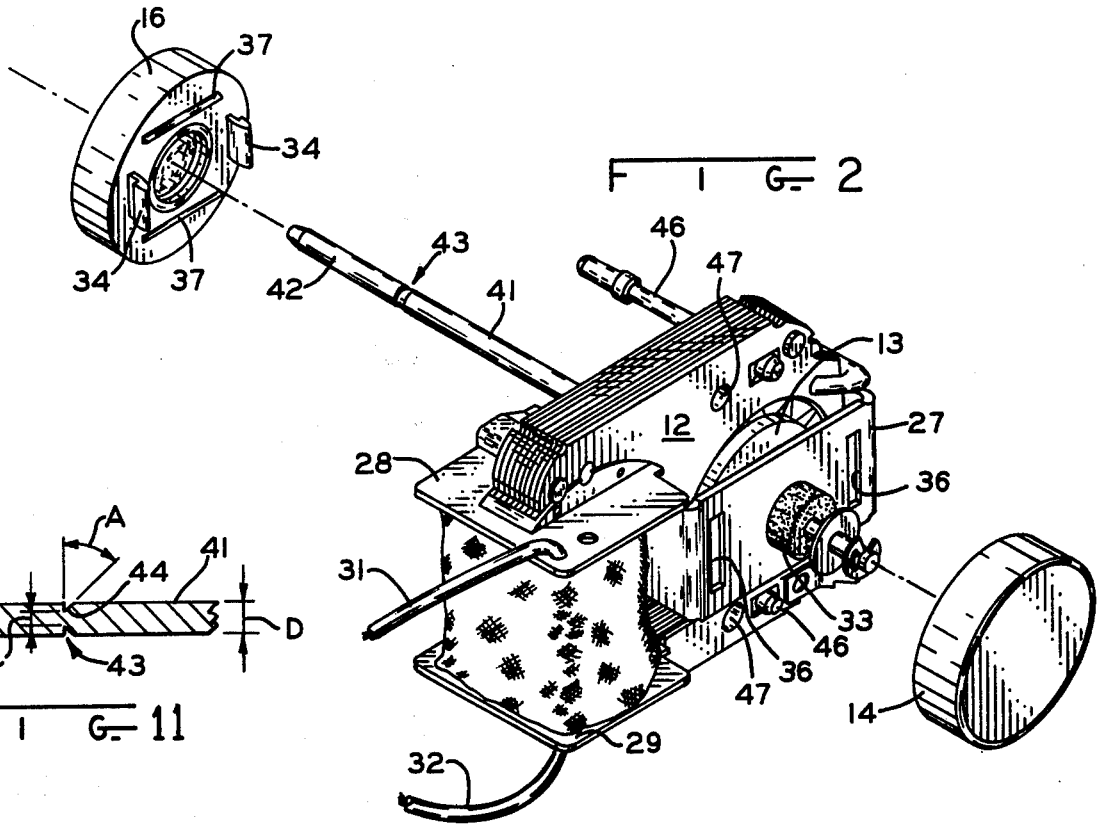
FIG. 2 is an exploded perspective view of a motor that includes a stator, rotor, and lubricant reservoirs taken from the kit of FIG. 1.

With reference now to FIG. 2, the motor there shown includes the stator and rotor assemblies 12, 13; and oil well covers or lubricant reservoirs 14, 16. The assembled relationship of stator and rotor assemblies 12, 13 is established by end frames 27 as will be understood. Although any suitable assembly technique may be used, those described in Rutledge et al U.S. Pat. No. 3,359,628 were used to establish and maintain the concentric relationship between the rotor and stator assemblies in the case of the FIG. 2 structure. The winding leg of the FIG. 2 skeleton motor supports a stator winding disposed between the insulating flanges 28, 29 and covered by insulating tape.

The lubricant reservoirs 14, 16 may be quickly and readily assembled with the end frames 27 of the motor because these reservoirs are of the detachable type, all as is fully described in the M. E. Wendt U.S. Pat. No. 3,500,087. Each of the lubricant reservoirs illustrated in the drawings include fastening means 34 that are receivable in appropriate openings 36 in each of the end frames. The ribs 37 assist in preventing rotation of the lubricant reservoirs relative to the end frames. Thus, the reservoirs 14, 16 may be readily snapped into assembled relationship with the bearing supports or end frames 27 and the motor then mounted in a selected piece of equipment.

Prior to such mounting, it would be determined whether the length of the shaft 41 was correct as supplied or whether one or more segments 42 of the shaft should be removed in order to obtain a final shaft length corresponding to a desired nominal length. To facilitate removal of shaft segments 42, a weakened section of shaft 43 is provided, e.g., by cutting a groove or notch in the shaft so that the shaft may be readily broken without necessarily having to clamp the motor in a vice or taking the chance of bending the shaft by cutting it with a hacksaw. Moreover, the groove 44 eliminates the need to measure and then mark a location on the shaft where it is to be severed.

The specific dimensions and shape of the groove 44 are not critical. It is, of course, important that sufficient shaft cross-sectional area be under the groove 44 to avoid inadvertent breakage of the shaft during handling and shipping, or during operation of the motor. On the other hand, it is desirable that the groove 44 be sufficiently deep to permit breaking of the shaft by gripping it on both sides of a groove with two pairs of pliers, and then stressing and breaking the shaft at the groove.

Figure 11:
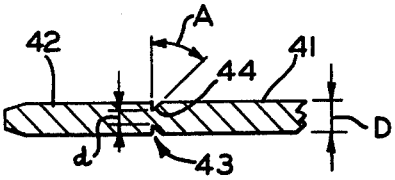
FIG. 11 is an enlarged cross-sectional view, with parts broken away, to more clearly illustrate one reduced diameter portion of the shaft of the motor shown in FIG. 2.

FIG. 11 is presented for purposes of exemplification only, to illustrate relative proportions and dimensions that we have found suitable for a cold drawn steel shaft 41 having a nominal diameter D of 0.187 of an inch. In this particular case, the diameter d was about 0.08 to 0.10 of an inch, and the angle A was about 45°.

Turning once again to FIG. 2, the resilient plastic or other suitable material pins 46 may be used as part of a vibration damping system as has been taught heretofore. The openings 47 in the laminated stator core are adapted to receive mounting means of various types as will be explained in connection with FIGS. 7–9 hereinafter. However, in some applications it may be necessary to resiliently mount the motor of FIG. 2 by suspending it from the lubricant reservoirs.

Figure 4:
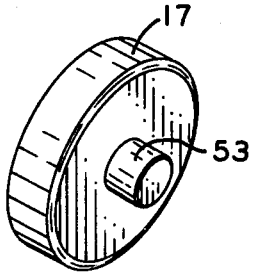
FIG. 4 is a view of one of the lubricant reservoirs forming part of the kit of FIG. 1, this reservoir being one for the opposite pulley end of the motor and being of a type that may be used for resilient mounting applications.
Figure 5:
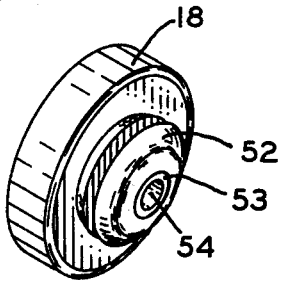
FIG. 5 shows a pulley end reservoir or cover that is otherwise similar to the one shown in FIG. 4 except that a resilient mounting member is assembled therewith, it being noted that the illustrated resilient mounting member is also taken from the kit of FIG. 1.

For an application such as this, the lubricant reservoirs such as the reservoirs 17 and 18 of FIGS. 4 and 5 would be used. The reservoirs 17, 18 are quickly attachable or detachable and are essentially identical to corresponding ones of reservoirs 14, 16; with the exception that reservoirs 17, 18 are provided with axially projecting hubs 53. The reservoirs 17, 18 are attachable to the end frames of the motor by snapping not shown attaching means or latches (like those shown in FIG. 2 at 34) into end frame openings 36.

The hubs 53 provide a means by which a rubber or other resilient material mounting ring 52 may be supported. Hubbed structures and mounting arrangements of this type are generally known in the art and are shown and described for example in Kaeding U.S. Pat. No. 3,270,227 which issued Aug. 30, 1966. Another patent that illustrates an arrangement of this type is Baclawski U.S. Pat. No. 3,168,663. For purposes of illustration, the ring 52 for cover 17 has not been shown in FIG. 4; but it will be understood that the kit 10 includes as many rings 52 as may be desired.

The resilient mounting members 52 are slipped onto the hubs 53. As will be understood, the pulley end cover 18 (of FIG. 5) includes a centrally disposed opening 54 through which the shaft 41 extends after the cover 18 is assembled with the motor. Of course, the cover 16 of FIG. 2 also is provided with a shaft accommodating hole.

Figure 6:
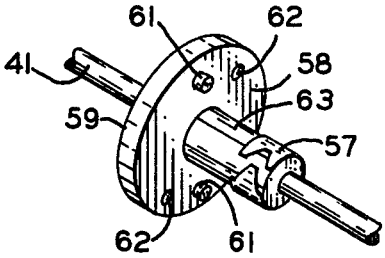
FIG. 6 is a view showing a fan mounting adapter mounted on the shaft of the motor of FIG. 2, this adapter also having been taken from the kit of FIG. 1.

Various applications may require different types of adapters by means of which fan means or other devices may be driven by shaft 41. FIG. 6 illustrates an adapter 56 that was made of nylon with reinforcing ring 57 that may be made of soft iron or aluminum, as desired. The adapter 56 is dimensioned to slip fit onto and be frictionally driven by the shaft 41. The adapter 56 may be mounted with either of faces 58, 59 facing the free extremity of the shaft. Driving pins or lugs 61 or openings 62 adapted to receive driving pins may be used to transmit power to a fan means or other device to be driven from shaft 41.

Figure 7:
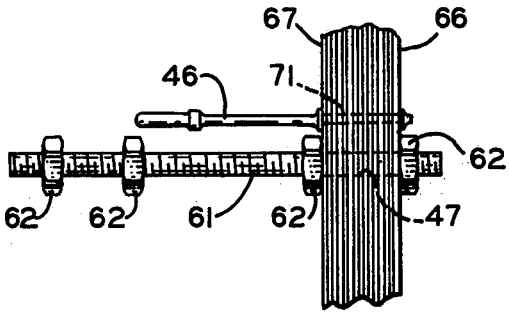
FIG. 7 is a side elevation with parts broken away and parts removed of a portion of the motor of FIG. 2 with mounting members from the kit of FIG. 1 assembled therewith.

For stud mounting applications of the FIG. 2 motor, an arrangement as shown in FIG. 7 may be used. In this case, threaded studs 61 are positioned in the openings 47 of the stator core, with a plurality of nuts 62 securing the stud to the motor and to a not shown mounting panel or other structure of an appliance to which the motor is to be mounted. The desired number of mounting studs 61 and nuts 62 are included in the kit 10.

Figure 8:
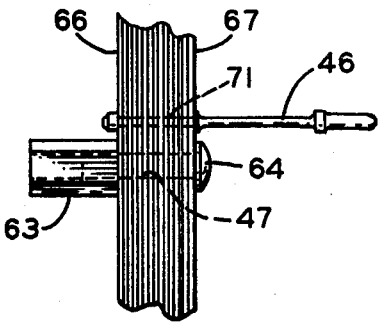
FIGS. 8, 9 and 10 are views that differ from FIG. 7 in that other mounting members from the kit of FIG. 1 are assembled as part of the motor of FIG. 2.

For some other applications, structure such as that shown in FIG. 8 may be used. In this case, threaded bushings 63 are fastened to the stator by means of screws or other suitable fasteners 64 disposed in the openings 47. It will be appreciated from comparing FIGS. 7 and 8 that the studs or threaded bushings may project on either side of the core. For example, the bushings 63 may be disposed against the face 66 or the face 67 of the stator core, as desired.

Figure 9:
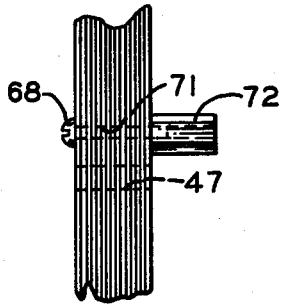
Figure 10:
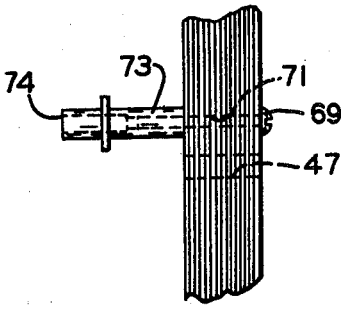

FIGS. 9 and 10 show still other mounting arrangements where pins 46 either are not supplied or have been removed from openings 71 of the stator, and where threaded fastening means such as self tapping or machine screws 68, 69 are received in the openings 71 so as to fasten bushings 72, 73 to the motor stator. In FIG. 9, a number six screw is received in bushing 72 which in turn will receive a number six mounting screw. In FIG. 10, the bushing 73 is adapted to receive a relatively larger number ten mounting screw.

All of the various adapting instrumentalities herein discussed are preferably included in the package 21 shown in FIG. 1. Thus, it is a relatively simple matter for anyone desiring to replace a motor in the field to select which of those instrumentalities are needed for the particular application, select the appropriate lubricant reservoirs, and determine the desired final or working length of shaft 41.

It will be understood that two or more weakened sections may be provided along the shaft 41 (e.g., by providing two or more grooves) so that the motor may be put into operation with a shaft having any one of two or more different nominal lengths as desired. Extra lengths of lead wire material 31, 32 will also usually be supplied and the excess portion of such material can be removed and discarded upon installation of the motor.

It will be understood that replacement motors have conventionally been supplied heretofore with extra long leads which could then be severed to a desired length. Moreover, replacement motors conventionally have been supplied with sufficient power capabilities to equal or exceed all of the originally installed motors that the replacement motors were intended to replace. However, these replacement motors have been fully assembled with lubricant reservoirs and end frames at the factory. Some totally enclosed type replacement motors have been supplied with a mounting adapter plate and/or with extra studs or through bolts. Then, in the field, it has been necessary to remove the factory installed through bolts and replace them with the supplied extra bolts.

In those cases heretofore where extra length shafts have been provided on replacement motors, the shafts have been shortened (when necessary) by cutting off excess shaft material with a hacksaw. While larger shafts (e.g., $\frac{3}{8}$ inch diameter and larger) may withstand the stresses associated with such procedures without bending; smaller shafts (e.g., $\frac{1}{4}$ inch diameter and smaller) would be more likely to bend. Moreover, such stresses would be more likely to damage bearing alignment in the smaller shaft motors.

It should now be apparent that motors or kits embodying the invention may be in different forms in actual practice. Moreover, different types of adapting instrumentalities may be supplied in kits exemplifying our invention. Accordingly, while we have illustrated and described specific exemplifications of the present invention, it will be appreciated that the principles of the invention are applicable to arrangements and structures other than those illustrated. Therefore, it will be understood that changes and modifications may be made in the preferred embodiments without departing from our invention, and it is aimed in the appended claims to cover all such changes and modifications as fall within the true spirit and scope of the invention.

What we claim as new and desire to secure by Letters Patent of the United States is:

1. A replacement motor kit comprising an enclosure having a plurality of compartment means defining spaced apart regions therein for receiving electric motor components; a skeleton motor stator assembly and rotor assembly confined in a first one of the spaced apart regions by a first compartment means; a plurality of lubricant reservoir covers confined in a second one of the spaced apart regions by a second compartment means; and adapting instrumentalities confined in a third one of the spaced apart regions by a third compartment means; the rotor assembly including a shaft having at least one weakened section located a predetermined distance from the free end of the shaft, and the stator and rotor assemblies being permanently secured in aligned relationship; said lubricant reservoirs being of the quickly attachable type and each including means for latching such lubricant reservoir in assembled relationship with the stator and rotor assemblies.

2. The structure of claim 1 wherein the first one of the spaced apart regions is contoured to accommodate the stator and rotor assemblies; and the adapting instrumentalities include a plurality of members for securing the stator assembly to a motor supporting structure.

3. A motor kit comprising a compartmentalized container having a partially assembled motor therein; said motor having a stator assembly including a stator core, a rotor assembly, and at least one end frame; said end frame including mounting means for accommodating lubricant reservoir attaching means; said kit further comprising at least two different lubricant reservoirs including attaching means for fastening a lubricant reservoir to the at least one end frame; and fastening means for securing the stator assembly to a motor supporting structure; said different lubricant reservoirs and fastening means being disposed and retained in the container in at least one portion thereof separate from said stator assembly.

4. The structure of claim 3 wherein the rotor assembly includes a shaft extending axially beyond an end face of the stator core; said axially extending portion of the shaft having at least one weakened section of reduced diameter located a predetermined distance from the free end of the shaft, the weakened section being located between two sections of the shaft each having substantially the same nominal diameter whereby the shaft may be readily broken along the weakened section thereof.

5. The structure of claim 4 wherein said section of reduced diameter is adapted to transmit torque to a device driven by the shaft.

6. A replacement motor kit comprising an enclosure having at least one region therein for receiving a skeleton motor stator assembly and rotor assembly; the rotor assembly including a shaft having at least one weakened section located a predetermined distance from the free end of the shaft, and the stator and rotor assemblies being secured together in operative relationship.

7. A replacement motor kit comprising an enclosure having at least one region therein for receiving a skeleton motor stator assembly and rotor assembly; said stator assembly and rotor assembly being secured together in operative relationship; the rotor assembly including a shaft portion extending from the stator assembly to a free end thereof, and means to cause fracture of the extending shaft portion at a predetermined extended location thereof between the free end of the shaft and the stator assembly upon the application of manually applied stresses in the vicinity of such locations; the means to cause fracture comprising a shaft section of reduced cross-sectional area of sufficient size to provide for torque transmission to a device driven by the shaft during normal operation of the stator and rotor assembly.

8. A replacement motor kit comprising an enclosure having at least one region therein for receiving a skeleton electric motor comprising a stator assembly and rotor assembly secured together in operative relationship; the rotor assembly including a shaft portion extending from the stator assembly to a free end thereof and including means to cause fracture of the shaft at a predetermined extended location from the stator assembly upon the application of manually applied stresses in the vicinity of such location; the means to cause fracture comprising a shaft section of reduced cross-sectional area of sufficient strength for transmitting useful torque to a device driven by a portion of the shaft extending between the free end of the shaft and the section of reduced cross-sectional area.

* * * * *